United States Patent [19]

Gerdes

[11] Patent Number: 4,582,253

[45] Date of Patent: Apr. 15, 1986

[54] SPRAY AERATOR

[75] Inventor: Gerald E. Gerdes, Wallingford, Conn.

[73] Assignee: WPM, Inc., Waterbury, Conn.

[21] Appl. No.: 704,780

[22] Filed: Feb. 25, 1985

[51] Int. Cl.[4] ..... E03C 1/084

[52] U.S. Cl. ..... 239/1; 239/428.5; 239/447; 239/600

[58] Field of Search ..... 239/1, 428.5, 444, 446, 239/447, 600

[56] References Cited

U.S. PATENT DOCUMENTS

| | | | |
|---|---|---|---|
| 3,682,392 | 8/1972 | Kint | 239/447 |
| 4,221,337 | 9/1980 | Shames et al. | 239/428.5 |
| 4,330,089 | 5/1982 | Finkbeiner | 239/447 |

*Primary Examiner*—Andres Kashnikow
*Assistant Examiner*—Scott D. Malpede
*Attorney, Agent, or Firm*—Davis Hoxie Faithfull & Hapgood

[57] ABSTRACT

A spray aerator essentially of simple plastic parts having a swivel faucet attachment, a water conduit pipe, lateral openings in the pipe wall above its closed lower end, a spray housing slidable on the pipe, first and second housing inserts within the spray housing and slidable on the pipe, a flanged flexible snap retainer having downwardly depending legs and snapped over the lower pipe end into a groove to retain the spray housing and housing inserts on the pipe, a spray insert snapped over a ledge at the lower end of the spray housing, the spray insert having outer spray holes and an inner cylindrical tube for an aerator housing, an aerator assembly mounted in the aerator housing and supporting the first housing insert thereabove, and the snap mounting of the spray insert and snap retainer being the only means holding the spray aerator assembled and retained in the conduit pipe. In the spray mode, water flows through the pipe lateral openings to a first chamber between the second housing insert and conduit pipe, then to a second chamber between the spray housing wall and first housing insert, then out the spray holes in the pray insert. In the aeration mode, water flows through the insert, then out through the aerator assembly. The snap retainer provides two stops for the vertically displaced spray mode and aeration mode, respectively. Beveled surfaces on the snap retainer and a collapsible notch in the lower pipe end facilitate snapping the snap retainer over the lower pipe end. Sealing rings are provided in the spray aerator at separate points. A very simple and fast assembly sequence is provided by the above construction.

12 Claims, 1 Drawing Figure

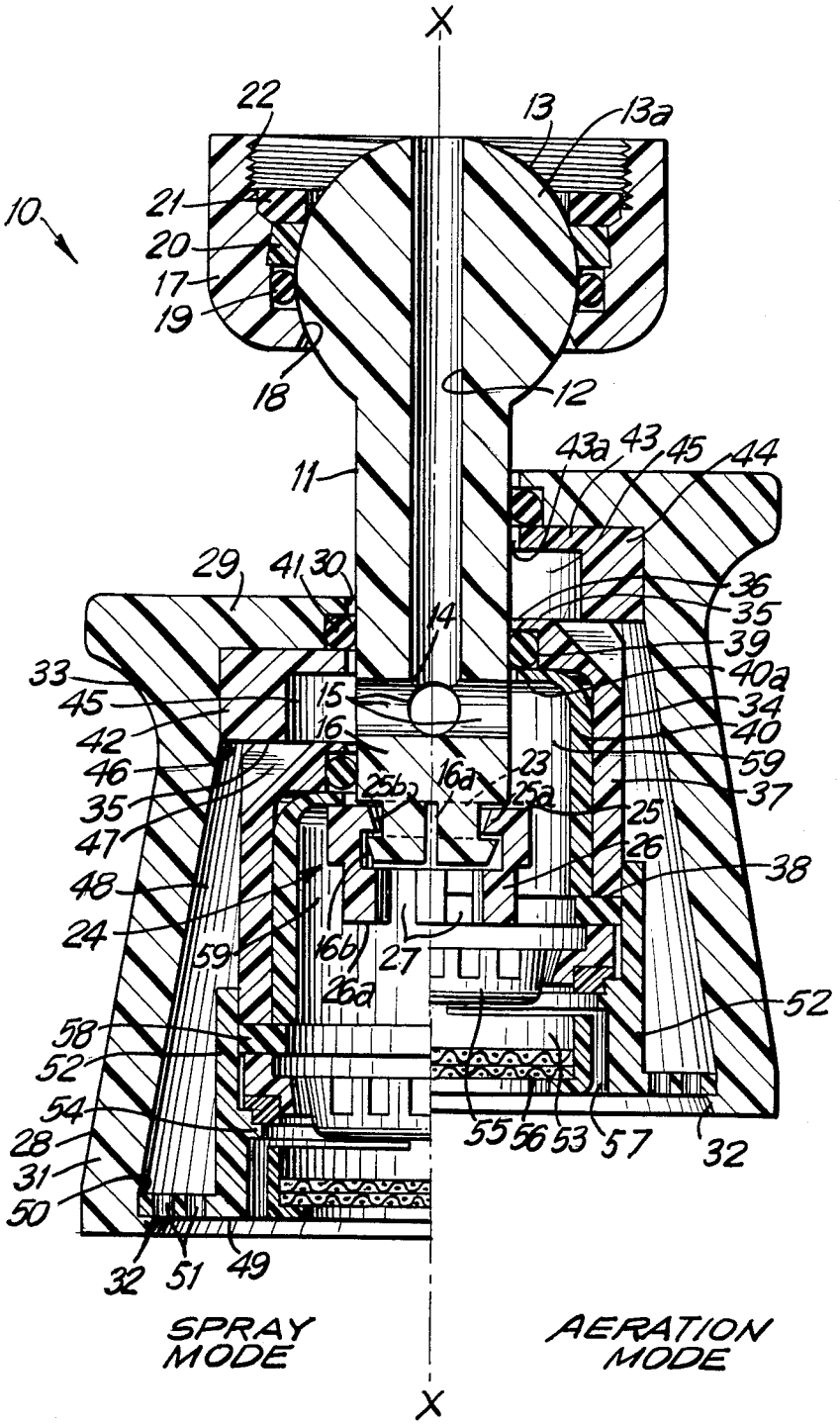
X
22
13
13a
10
21
20
17
19
18
12
11
43a
43
45
44
29
41
30
36
35
39
40a
34
40
59
37
33
45
42
46
35
47
48
24
59
15
16
14
16a
23
25b
25a
25
26
38
16b
27
26a
52
58
52
54
28
31
50
55
56
53
57
32
32
51
49
SPRAY MODE
AERATION MODE
X

SPRAY AERATOR

BACKGROUND OF THE INVENTION

This invention relates to spray aerator devices for attachment to faucets, and particularly of the type that can be manually operated to either an aeration mode or a spray mode. In the former instance, an aerated stream of water is delivered from the spray aerator; in the latter instance, a non-aerated spray is delivered from the spray aerator.

Spray aerator devices generally are well-known, and commonly have various problems of manufacture, assembly and/or operation associated therewith. Such devices may require the molding of intricate shapes of plastic parts and excessive numbers of such parts, thereby increasing the cost of manufacture and requiring excessive assembly operations. In particular, such devices usually require the use of threaded interconnections between various parts, screws and/or other elaborate fastening means which also increase the cost of manufacture and assembly, the time required for assembly, and require exact axial alignment of threaded parts to obtain proper assembly. Representative of prior art spray aerators are the devices disclosed in U.S. Pat. Nos. 2,989,249; 2,990,122; 3,286,935; 3,334,818; 3,520,481; 3,524,591; 3,623,670; 3,680,791; 3,682,392; 3,706,418 3,722,798; 3,768,735; 3,786,995; 3,884,418; 3,902,671; 4,221,337; and 4,221,338.

SUMMARY OF THE INVENTION

The spray aerator of the present invention serves to eliminate the above disadvantages, providing relatively few plastic parts of relatively simple moldable shapes, and particularly requiring no threaded interconnections between parts nor screw connections to fully assemble the invention. The spray aerator of the present invention accordingly can be manufactured and assembled economically, easily and very quickly.

The spray aerator of the present invention includes a water conduit pipe for mounting at its upper end (through swivelling means if desired) to a faucet and having lateral water passages through the conduit pipe wall short of the bottom of the pipe. A spray housing slides on the pipe and first and second housing insert means also are slidably mounted on the conduit pipe inside the spray housing. The second housing insert defines a first chamber above the first housing insert, the spray housing wall and first housing insert define a second chamber therebetween, and means are provided to interconnect the first and second chambers. The first housing insert also defines a third chamber inwardly thereof, and sealing ring means are provided adjacent the first and third chambers. Snap retainer means, essentially tubular in configuration, are provided to snap over the lower closed end of the conduit pipe and hold the spray housing and first and second housing inserts (and sealing ring means) on the conduit pipe. A collapsible diametrical notch in the lower closed end of the conduit pipe, as well as one or more beveled surfaces relative to the lower closed pipe end and the snap retainer, facilitate snapping of the snap retainer onto the lower closed pipe end, and an inwardly directed flange at the upper end of the snap retainer snaps into an encircling groove in the lower closed pipe end to lock the snap retainer in place. The spray housing further has an inwardly extending ledge about its lower end and a spray insert means snaps upwardly over and is retained by the ledge. The spray insert has spray openings about its periphery entering into the second chamber, and the sprayer insert inner portion forms a housing for and retains an aerator assembly positioned below the third chamber. The snap retainer also has respective surfaces to form respective stops for the spray aerator in its aeration and spray modes as it is manually shifted therebetween. When the spray aerator is positioned in the spray mode, water flows from the conduit pipe through its lateral wall passages sequentially into the first chamber, the second chamber and thence through the spray openings in the spray insert member. In the aerator mode, water flows from the conduit pipe through its lateral wall passages sequentially into the third chamber and thence through the aerator assembly. The snapping of the spray insert means into the spray housing, and the snapping of the snap retainer over the lower closed pipe end, form the attachment means to maintain the spray housing, spray insert member, aerator assembly and housing inserts in assembled condition and retained upon the conduit pipe.

To assemble the aerator, the aerator assembly is mounted in the spray insert member, and sequentially the spray housing is slid onto the lower end of the conduit pipe, the housing insert members are slid onto the lower pipe end, the snap retainer is snapped over the lower pipe end, and the spray insert member with aerator assembly is snapped into the spray housing. The assembly of the spray aerator is thereby quickly and easily completed and held against dislodgement from the lower pipe end.

Other details and advantages of the present invention are disclosed in the drawing and following detailed description.

BRIEF DESCRIPTION OF DRAWING

The single FIGURE illustrates a cross-seetional view of the invention taken along its central axis and showing on respective sides of the central axis the separate spray and aeration modes of the invention.

DETAILED DESCRIPTION OF INVENTION

Referring to the drawing, spray aerator 10 of the present invention is shown in cross-section. The drawing to the right side of central axis x—x illustrates the spray aerator in the aeration mode solely, and the drawing to the left side of central axis x—x illustrates the spray aerator in the spray mode solely. The parts on both sides of the central axis are identical, the only difference between the right and left sides being the vertical displacement of certain members in relation to conduit pipe 11. All parts of spray aerator 10 take a generally circular configuration in planes perpendicular to central axis x—x, and the spray aerator is constructed essentially of plastic parts.

Conduit pipe 11 has water conduit 12 extending axially from upper end 13 of the pipe to a position 14 at which a plurality of openings 15 extend laterally through the side wall of pipe 11. The lower end 16 of pipe 11 is closed. As shown, the upper end 13 of pipe 11 may be an enlarged ball **13*a* that is retained within and allowed to swivel in respect to socket and faucet attachment 17. In this manner the spray aerator may be provided with a swivelling capability if desired. Socket 17 includes lower curved retaining surface 18, recess-mounted sealing ring 19 and upper snap-in ring 20 that retains sealing ring 19 in position. Washer 21** overlies snap-in ring 20, and snap-in ring 20, configured as shown, assures that sealing ring 19 will not be displaced or lost as might be the case if only a washer were used for retention. The ball-retaining member 17 includes threads 22 (male or female) for connection to an overlying faucet (not shown).

At the lower closed end 16 of conduit pipe 11 is formed split 16*a* constituting a collapsible notch passing diametrically through pipe 11*a* from one side to the other. Also at lower end 16 of pipe 11 is provided retaining groove 23 encircling the pipe. Snap retainer member 24, generally of open tubular configuration and flexible, is snapped onto the lower pipe end 16 and retained thereon. Snap retainer 24 has upper end horizontal circular surface 25 and inwardly directed circular flange 25*a* surrounding the central opening at the upper end of snap retainer 24. Inwardly directed flange 25*a* fits within retaining groove 23 after snap retainer 24 has been snapped onto lower end 16 of pipe 11. Flange 25*a* has beveled surface 25*b* and lower pipe end 16 has beveled surface 16*b* below retaining groove 23. The combination of beveled surfaces 25*b* and 16*b* (or the beveling of at least one of the two surfaces), the flexibility of snap retainer 24, and the collapsibility of notch 16*a*,act together to allow snap retainer 24 to be pushed and cammed onto lower pipe end 16 from below. As surface 25*b* rides up surface 16*b*, flange 25*a* is stressed outwardly and the pipe material on opposite sides of notch 16*a* is stressed radially inwardly to close the notch 16*a*. Flange 25*a* as it is pushed upwardly then snaps into retaining groove 23, and notch 16*a* then is free to open back up to the position shown. Snap retainer 24 also has a few integral legs 26 extending downwardly and spaced about the periphery of the lower end of snap retainer 24, the legs 26 terminating at bottom surfaces 26*a* and water passage spaces 27 being provided between legs 26.

It should be understood that the mating of snap retainer 24 with lower pipe end 16 is illustrated with exaggerated spacing therebetween to facilitate understanding of the above description. Snap retainer 24 is locked onto the lower pipe end 16 solely by the above-described construction and snap-action, and generally serves as a very simple and speedy fastening means to retain the other parts of the spray aerator upon conduit pipe 11. Snap retainer 24 further provides two stops to respectively define the spray mode and aeration mode of the spray aerator, all as more fully described hereafter.

Spray housing 28 is slidable upwardly and downwardly on conduit pipe 11, having upper end 29 with circular opening 30 therein that is only slightly larger than and encircles pipe 11. Circumferential side wall 31 of spray housing 28 extends downwardly from upper end 29 and encircles conduit axis x—x at a distance therefrom. Spray housing 28 at its open lower end has an inwardly extending circumferential retaining ledge 32. The optional curvature 33 on a portion of spray housing side wall 31 provides finger placement means to slide the spray housing 28 upwardly on pipe 11 to operate the present invention to the aeration mode as hereinafter described.

Also slidable upwardly and downwardly on conduit pipe 11 is first housing insert 34 positioned within spray housing 28 and having upper end 35 with a central opening 36 which also is only slightly larger than and encircles the pipe 11. Circumferential side wall 37 of first housing insert 34 extends downwardly from upper end 35 and encircles the conduit axis x—x at a distance spaced outwardly from conduit pipe 11 and spaced inwardly from spray housing side wall 31, the first housing insert 34 also being open at its lower end 38. Sealing ring 39 is positioned within central opening 36, to seal upper end 35 and pipe 11 against the passage of water therebetween, and cup-shaped member 40 internal and contiguous to first housing insert 34 has its upper end 40*a* serving to retain sealing ring 39 in position as shown.

Also positioned in central opening 30 of upper end 29 of spray housing 28 is water-sealing ring 41, ring 41 being held in position by second housing insert 42. Second housing insert 42 is likewise slidable upwardly and downwardly on conduit pipe 11, second housing insert 42 having upper end 43 with central opening 43*a* only slightly larger than and encircling pipe 11 and having downwardly extending circumferential side wall 44 spaced from and encircling pipe 11 to define a first chamber 45 between pipe 11 and side wall 44. The upper end 43 of second housing insert 42 is seated against the upper end 29 of spray housing 28 and the lower end 46 of second housing insert 42 sits upon upper end 35 of first housing insert 34. A plurality of grooves or notches 47 surrounding pipe 11 are positioned in the upper peripheral surface of first housing insert 34 and provide passage means interconnecting first chamber 45 to a second chamber 48 defined between side wall 37 of first housing insert 34 and side wall 31 of spray housing 28.

At the bottom of spray housing 28 is positioned spray insert member 49 surrounding axis x—x, the peripheral edge 50 of which is snapped from below past, and rests upon, inwardly extending retaining ledge 32 of spray housing 28. Spray housing 28 has sufficient flex at its lower end to permit circumferential edge 50 to be snapped past circumferential ledge 32. Spray insert member 49 has an outer peripheral circumferential portion having numerous spray openings 51 opening from below the spray aerator into second chamber 48. Spray insert member 49 further has integral inner and upwardly extending cylindrical flange 52 which serves as a housing for and supports aerator assembly 53 by inner ledge 54. Aerator assembly 53 generally is of a well-known type, for example as disclosed in Bock U.S. Pat. No. 4,345,719 for "Water Aerator", issued Aug. 24, 1982, which patent is incorporated herein by reference, and includes diffuser basket 55, screens 56, air entrance opening 57 and overlying washer 58. The lower end 38 of first housing insert 34 (with its cup-shaped member 40) rests upon washer 58 in the assembled condition of the spray aerator as shown. The side wall 37 of first housing insert 34, with contiguous cup-shaped member 40, defines a third chamber 59 extending inwardly thereof and above aerator assembly 53.

To assemble the spray aerator of the present invention, which can be done manually or automatically, the spray housing 28 may be slid through its central opening 30 onto conduit pipe 11 from the lower end. Sequentially, sealing ring 41, second housing insert 42, first housing insert 34, sealing ring 39, and cup-shaped member 40 are likewise slid onto conduit pipe 11 through their central openings, and snap retainer 24 is then snapped over lower pipe end 16 as above described to retain the above referenced parts on pipe 11. Aerator assembly 53 is then positioned within cylindrical flange 52 of spray insert 49, and the edge periphery 50 of the spray insert member is then snapped upwardly past inwardly extending retaining ledge 32 of spray housing 28 to complete the assembly.

The simplicity of the above assembly will be apparent, no screw-threaded interconnections between plastic parts nor screws or other elaborate fastening means are required, and it is solely the snap retainer 24 snapped over lower pipe end 16 and spray insert 49 snapped into the spray housing 28, that hold the spray housing 28, spray insert member 49, aerator assembly 53 and housing inserts 42 and 34 in assembled condition and retained upon the conduit pipe 11 of the spray aerator. The assembly can be carried out with great speed and simplicity, and there is no required exact axial alignment of mating threaded parts as is common in the prior art.

Turning now to the operation of the assembled spray aerator described above, the assembly of the spray housing 28, spray insert member 49, aerator assembly 53 and housing inserts 42 and 34 can be manually shifted upwardly on conduit pipe 11 to define the aeration mode (see drawing to the right side of axis x—x) or can be shifted downwardly on pipe 11 to define the spray mode (see drawing to the left side of axis x—x).

In the spray mode, upper horizontal surface 25 of snap retainer 24 provides a stop against further downward travel of first housing insert 34 and its cup-shaped member 40, the surface 25 abutting against upper end 40*a* of member 40 as shown. In this position, water passing down conduit 12 of pipe 11 exits lateral openings 15 through the pipe side wall into first chamber 45, then through grooves 47 in first housing insert 34 into second chamber 48, and from second chamber 48 out the bottom of the spray aerator through spray openings 51 in spray insert member 49. In this spray mode, no water can find its way into third chamber 59 and out through aerator assembly 53.

In the aeration mode, the bottom surfaces 26*a* of legs 26 of snap retainer 24 provide a stop against any further upward movement of the aerator assembly 53, by abutting against the diffuser basket 55 inner rim or a gasket or flow restrictor thereon. In this position, water passing down conduit 12 of pipe 11 exits lateral openings 15 through the pipe side wall into third chamber 59. The water then passes through spaces 27 between legs 26 of snap retainer 24, and down through aerator assembly 53 and out the bottom of the spray aerator of the present invention. In this aeration mode, maintained by the friction of sealing rings 41 and 39 against conduit pipe 11, no water can find its way into first and second chambers 45 and 48 and out through spray opening 51.

It is understood that various changes and modifications may be made in the foregoing embodiment without departing from the spirit and scope of the invention as hereafter claimed.

What is claimed is:

1. A spray aerator operable between a spray mode and an aeration mode, comprising in combination: a conduit pipe having a water conduit extending axially from an upper end of the pipe to a position terminating short of the lower end of the pipe; a plurality of openings extending laterally through the side wall of the pipe at said terminating position to allow water to pass therethrough; means to interconnect the upper end of the conduit pipe to a faucet; the lower end of the pipe having a retaining groove; a spray housing slidable upwardly and downwardly with relation to the conduit pipe; said spray housing having an upper end with a central opening encircling said conduit pipe and having a side wall extending downwardly from the spray housing upper end and encircling the conduit pipe axis at a distance therefrom, the spray housing being open at its bottom end and having an inwardly extending retaining ledge at said bottom end; a first housing insert positioned within said spray housing and slidable upwardly and downwardly with relation to the conduit pipe; the first housing insert having an upper end with a central opening encircling said conduit pipe and having a side wall extending downwardly from said housing insert upper end and encircling the conduit pipe axis at a distance spaced outwardly of the conduit pipe side wall and inwardly of the spray housing side wall, the first housing insert being open at its bottom end; means defining a first chamber within the spray housing situated above the first housing insert and surrounding the conduit pipe; the spray housing side wall and the first housing insert side wall defining a second chamber therebetween; means interconnecting the first chamber to the second chamber; a spray insert member snapped past and held in place by the inwardly extending retaining ledge at the bottom open end of the spray housing; the spray insert member having an outer peripheral portion with spray openings therein extending into the second chamber and having an inner . aerator-supporting portion; an aerator assembly supported by said inner aerator-supporting portion of the spray insert member, the aerator assembly supporting the first housing insert above and about the outer periphery of the aerator assembly; the inner side wall of the first housing insert defining a third chamber extending above the aerator assembly; a snap retainer member snapped over the lower closed pipe end and held by the retaining groove at the lower end of the conduit pipe; the snap retainer member having a first surface means preventing downward dislodgement of the spray housing and first housing insert off the lower end of the conduit pipe and providing a stop defining the lower (spray mode) position of the first housing insert on the conduit pipe; the snap retainer member having a second surface means providing a stop defining the upper (aeration mode) position of the aerator assembly; the spray housing, spray insert member, aerator assembly and first housing insert being slidable as a unit in relation to the conduit pipe between a spray mode and an aeration mode; the first chamber being aligned with the lateral side wall openings in the conduit pipe in the spray mode and the third chamber being aligned with said lateral side wall openings in the aeration mode; wherein, the water flow in the spray mode passes sequentially through the lateral side wall openings into the first chamber, then into the second chamber, and from the second chamber outward through the spray openings of the spray insert member; and, the water flow in the aeration mode passes sequentially through the lateral side wall openings into the third chamber and from the third chamber downward through the aerator assembly.

2. The invention defined in claim 1, wherein the means defining the first chamber comprises a second housing insert slidable upwardly and downwardly with relation to the conduit pipe and positioned against the lower surface of the upper end of the spray housing, the second housing insert having an upper end with a central opening encircling the conduit pipe and having a downwardly extending side wall spaced from and encircling the conduit pipe to define the first chamber between the second housing insert side wall and the conduit pipe.

3. The invention defined in claim 2, wherein the upper end of the first housing insert is positioned against the bottom of the downwardly extending side wall of the second housing insert, and further comprising grooves in the outer surface of the first housing insert as the means interconnecting the first chamber to the second chamber.

4. The invention defined in claim 1, wherein said inner aerator-supporting portion of the spray insert member comprises an upwardly extending cylindrical wall acting as an aerator assembly housing and having inwardly extending ledge means to support the aerator assembly.

5. The invention defined in claim 1, wherein the snap retainer member has a plurality of downwardly extending legs defining water passages therebetween in the aeration mode from the third chamber into the aerator assembly, the bottom ends of the downwardly extending legs providing the said second surface means defining the aeration mode stop.

6. The invention defined in claim 1, wherein the first housing insert has a sealing ring positioned within the central opening of its upper end and a further internal cup-shaped member having an upper end retaining the sealing ring in position.

7. The invention defined in claim 2, wherein the spray housing has a sealing ring positioned within the central opening of its upper end and wherein the second housing insert retains the sealing ring in position.

8. The invention defined in claim 1, wherein the conduit pipe has a ball-shaped upper end, and the means to interconnect the upper end of the pipe to a faucet comprises a socket allowing swivelling of the ball and including a sealing ring and a snap-in retaining ring for the sealing ring.

9. The invention of claim 1, wherein the spray insert member snapped into the bottom end of the spray housing and the snap retainer member snapped over the lower end of the conduit pipe provide the sole fastening means utilized to maintain the spray housing, spray insert member, aerator assembly and first housing insert in assembled condition and retained upon the conduit pipe of the spray aerator.

10. The invention of claim 1, wherein the snap retainer is essentially tubular in configuration, has an inwardly directed flange about the opening at its upper end to lock within the retaining groove at the lower closed pipe end, and wherein beveling means are provided to facilitate snapping the snap retainer over the lower closed pipe end.

11. The invention of claim 10, wherein the lower closed pipe end has a collapsible diametrical notch therein.

12. A method of assembling a spray aerator having a conduit pipe with an upper end to be mounted to a faucet and a lower end, a spray housing, housing insert means defining alternate water flow paths, a snap retainer, spray insert means and an aerator assembly, comprising mounting the aerator assembly in the spray insert means and sequentially sliding the spray housing onto the lower end of the conduit pipe, sliding the housing insert means onto the lower end of the conduit pipe, snapping the snap retainer onto the lower end of the conduit pipe, and snapping the spray insert means with aerator assembly into the spray housing, whereby the spray housing, spray insert means, aerator assembly and housing insert means are held in assembled condition and retained as a unit on the pipe conduit by the snap retainer against dislodgement from the lower pipe end.

* * * * *